US006024160A

United States Patent [19]

Moribe et al.

[11] Patent Number: 6,024,160

[45] Date of Patent: Feb. 15, 2000

[54] PATTERN PLATE DRAWING APPARATUS

[75] Inventors: Yasuo Moribe, Gamagoori; Mitsuyuki Matsushita; Takahiro Taguchi, both of Toyokawa, all of Japan

[73] Assignee: Sintokogio, Ltd., Nagoya, Japan

[21] Appl. No.: 09/051,452

[22] PCT Filed: Aug. 7, 1997

[86] PCT No.: PCT/JP97/02764

§ 371 Date: Jun. 11, 1998

§ 102(e) Date: Jun. 11, 1998

[87] PCT Pub. No.: WO98/06523

PCT Pub. Date: Feb. 19, 1998

[30] Foreign Application Priority Data

Aug. 9, 1996 [JP] Japan ..... 8-227401

[51] Int. Cl.[7] ..... B22C 19/00

[52] U.S. Cl. ..... 164/159; 164/181; 164/412

[58] Field of Search ..... 164/180, 181, 164/187, 191, 44, 159, 412; 425/186, 175

[56] References Cited

U.S. PATENT DOCUMENTS

| | | | |
|---|---|---|---|
| 3,618,668 | 11/1971 | Dupre | 164/181 |
| 4,744,404 | 5/1988 | Sakoda et al. | 164/180 |
| 4,830,082 | 5/1989 | Bellis et al. | 164/180 |

*Primary Examiner*—Harold Pyon
*Assistant Examiner*—Mark A. Wentink
*Attorney, Agent, or Firm*—Limbach & Limbach L.L.P.

[57] ABSTRACT

An apparatus for drawing a pattern plate (1) upward from a carrier plate (2), which pattern plate is held in the carrier plate and transferred along a transport path, is disclosed. The apparatus comprises a first lifting cylinder (5) having an upwardly extendable piston rod (5A) and that is fixedly disposed below the transport path, a mount table (7) secured to the tip end of the first lifting cylinder piston rod (5), and second and third lifting cylinders mounted on the mount table in a spaced-apart relationship, the second and third lifting cylinders each having an upwardly extendable piston rod (9, 9A), a mount plate (10, 10A) secured to the tip end of the piston rod (9, 9A), and a plurality of draw pins (11, 11A) mounted upright on the mount plate.

4 Claims, 4 Drawing Sheets

PATTERN PLATE DRAWING APPARATUS

FIELD OF THE INVENTION

This invention relates to an apparatus for drawing a pattern plate upward from a carrier plate that has received the pattern plate from above into a cavity thereof and that carries it along a conveyor.

DESCRIPTION OF THE PRIOR ART

To draw a pattern plate upward from a carrier plate, conventionally bolt holes with threads have been previously formed in the upper surface at the four corners of the pattern plate, and hook bolts are then caused to engage with the holes. After this, wires are secured to the hook bolts, and the pattern plate is hoisted by a crane.

Since this operation requires much manual work, it takes a lot of time. Further, an operation to draw two carrier plates (or a carrier plate comprised of two blocks) held in a carrier plate necessitates different operational sequences, depending on whether the two plates or blocks are drawn upward simultaneously or one of them is drawn upward first. Such an operation has an inherent problem in that it is complicated and therefore is unsafe.

This invention has been conceived to resolve that problem. It aims to provide an apparatus that can draw upward, quickly and safely, two pattern plates simultaneously or one of them, from a carrier plate which holds them.

SUMMARY OF THE INVENTION

To the above end, the apparatus of this invention, for drawing a pattern plate upward from a carrier plate that holds the pattern plate and carries it along a transport path, comprises a first lifting cylinder having an upwardly extendable piston rod and that is fixedly disposed below the transport path, a mount table secured to the tip end of the first lifting cylinder piston rod, and second and third lifting cylinders mounted on the mount table in a spaced-apart relationship, the second and third cylinders each having an upwardly extendable piston rod, a mount plate secured to the tip end of the piston rod, and a plurality of draw pins mounted upright on the mount plate.

By moving the first cylinder piston rod upward, the draw pins can be moved into throughbores formed in the bottom of the carrier plate, which is located above the apparatus, and which holds a pattern plate, to thereby push up the pattern plate from the carrier plate. Or, by moving the second or third cylinder piston rod upward, the draw pins of the second or third cylinder can be moved into the throughbores formed in the bottom of the carrier plate to thereby push up the pattern plate from it.

DESCRIPTION OF THE PREFERRED EMBODIMENTS

The preferred embodiments are now explained in reference to the drawings.

Figure 1:
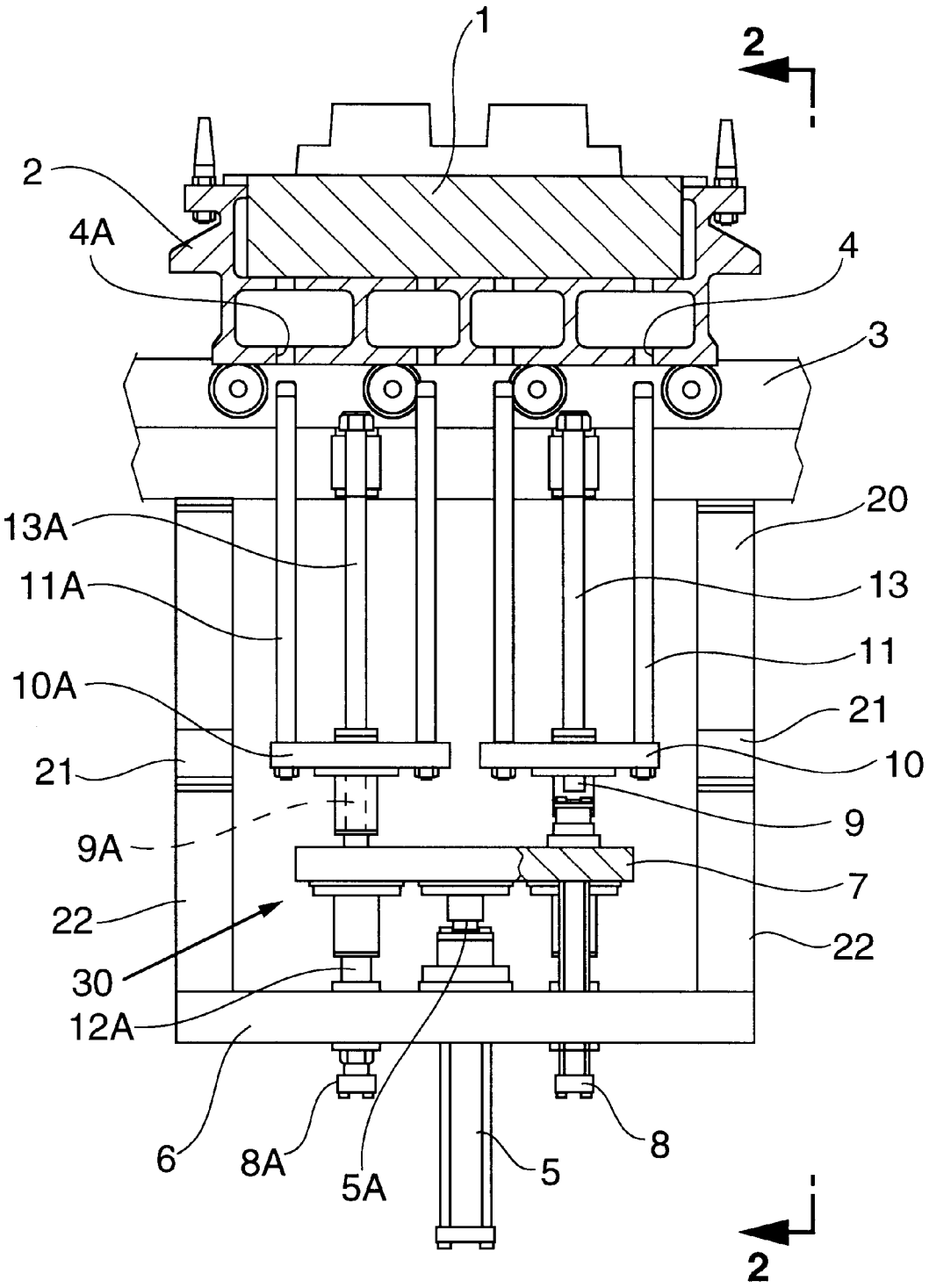
FIG. 1 is a cross-sectional side view of an embodiment of the apparatus of the present invention.
Figure 2:
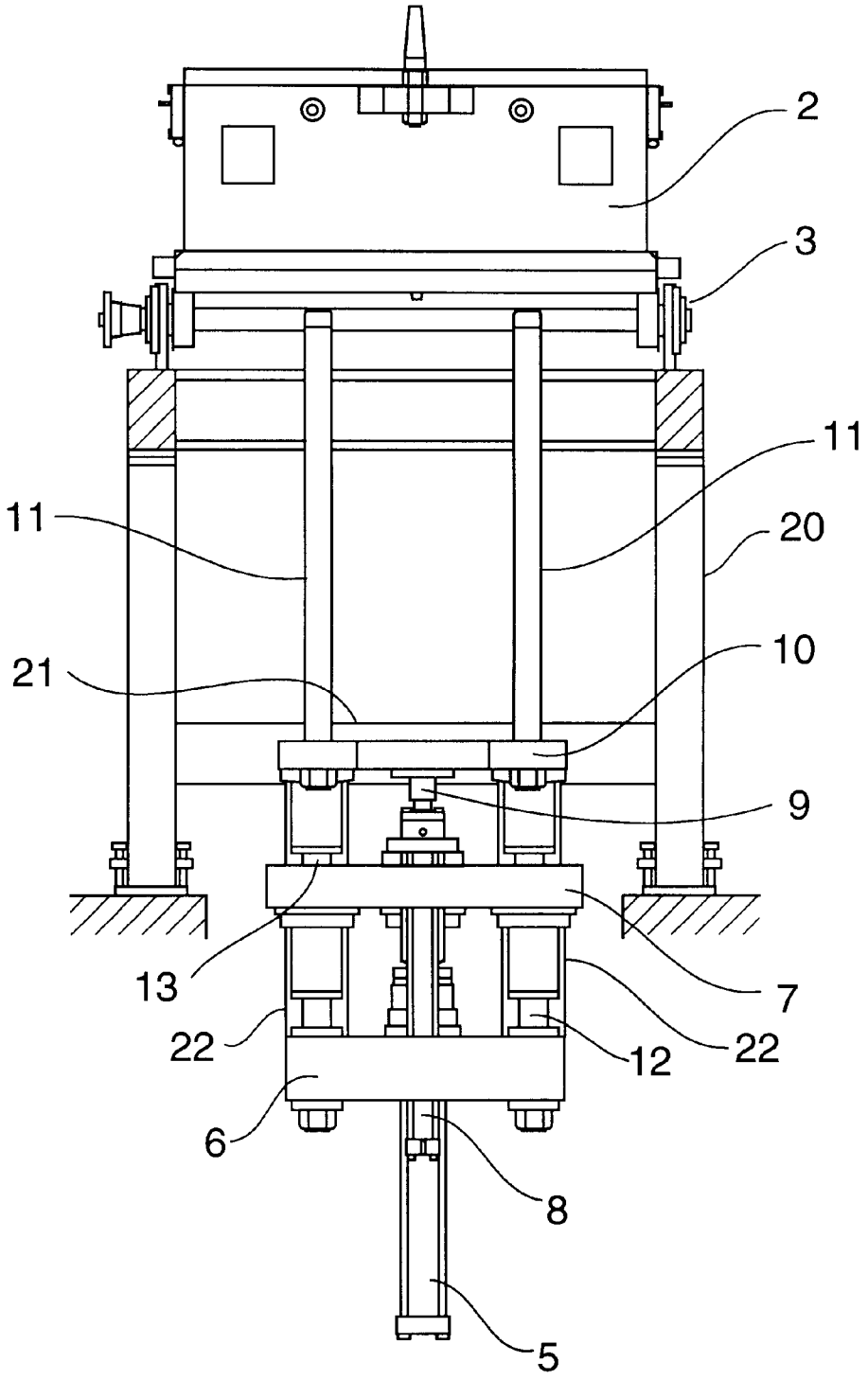
FIG. 2 is a view taken along line A—A in FIG. 1.

In FIGS. 1 and 2 a frame 20 is fixed on a floor, and a roller conveyor 3 is disposed on the frame such that it acts as a transport path. A carrier plate 2, which holds a pattern plate 1 therein, is positioned on the path 3. Eight throughbores 4, 4A are formed in the bottom of the carrier plate 2.

The carrier plate 2 receives a flask thereon for defining a molding space into which molding sand is charged. Therefore, the pattern plate 1 is fittingly placed in the carrier plate 2 such that it does not move in the carrier plate 2.

Under the transport path a drawing apparatus 30 is mounted on the central part of the frame 20. The frame 20 includes two tie beams 21,21 and four upright members 22, suspended from these tie beams. A horizontal frame member 6 is fixed to the ends of the upright members 22.

A first lifting cylinder 5 is mounted on the frame member 6 such that the piston rod 5A of the first lifting cylinder 5 can extend upward. A mount table 7 is horizontally secured to the tip end of the piston rod 5A. Two opposing and spaced-apart second and third lifting cylinders 8, 8A are mounted on the table 7 at both sides of the first lifting cylinder 5 (FIG. 1). Piston rods 9, 9A, of the second and third lifting cylinders 8, 8A respectively, can extend upward.

Mount plates 10, 10A are horizontally secured to the tip ends of the piston rods 9, 9A of the second and third lifting cylinders 8, 8A, respectively. Eight upright draw pins 11, 11A are secured to the mount plates 10, 10A respectively at their four corners. These draw pins 11, 11A correspond to throughbores 4, 4A, formed in the bottom of the carrier plate 2. The second lifting cylinder 8 has two guide rods 12, 12, which extend downward from the mount table 7 and engage the frame member 6, while the third lifting cylinder 8A has two guide rods 12A, 12A, which extend downward from the mount table 7 and engage the frame member 6. These guide rods 12, 12A prevent the mount table 7 from rolling and guide its vertical movement when it is lifted. Further, the second lifting cylinder 8 has a plurality of guide rods 13 (only one is shown in the drawings), which extend upward from the mount plate 10 and engage the frame 20, while the third lifting cylinder 8A has a plurality of guide rods 13A (only one is shown in the drawings), which extend upward from the mount plate 10A and also engage the frame 20. These guide rods 13, 13A prevent the mount plates from rolling and guide their vertical movement when they are lifted.

Figure 3:
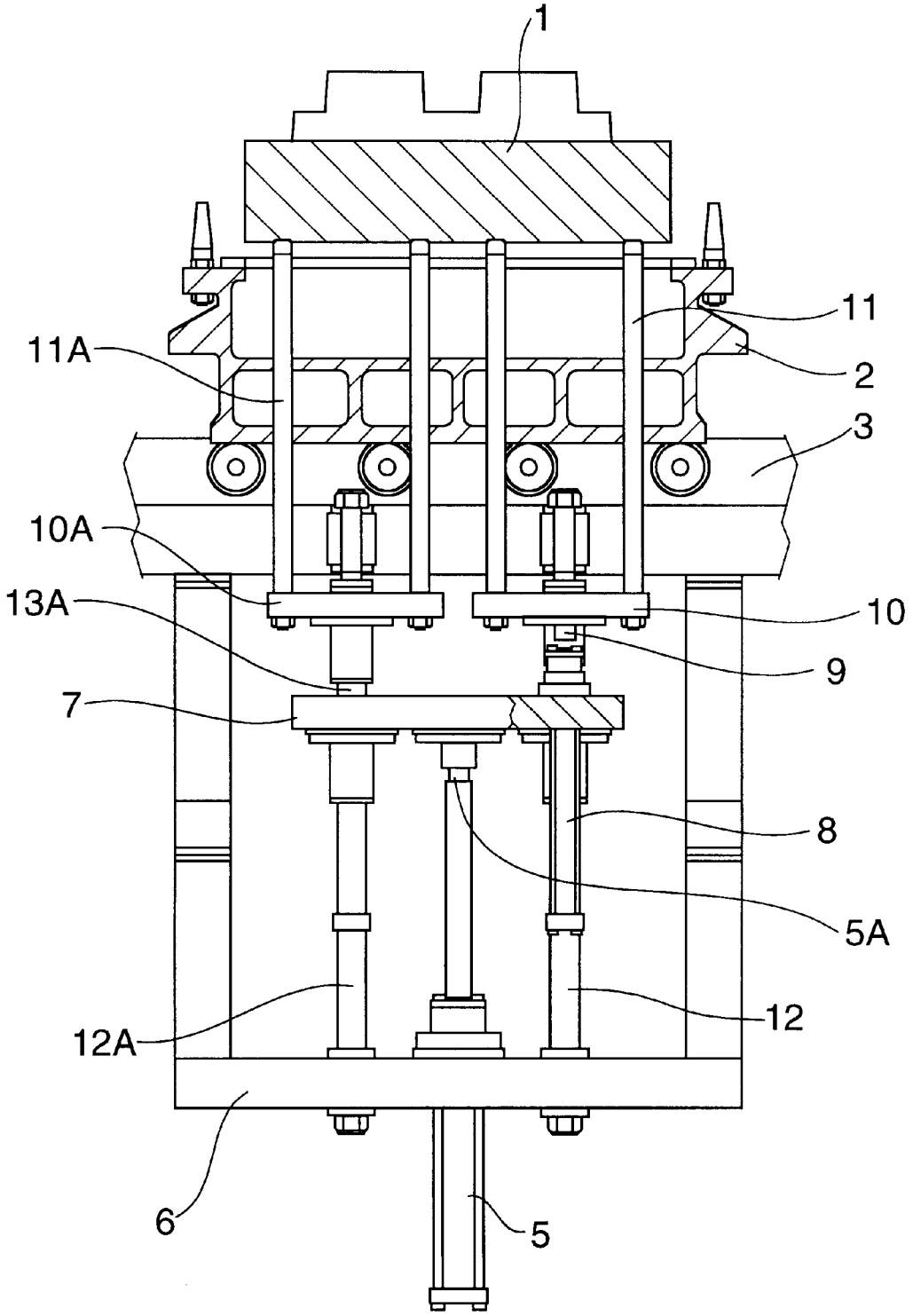
FIG. 3 is a cross-sectional side view similar to FIG. 1, where a pattern plate is drawn upward.

Now the operation of the drawing apparatus is explained. First, FIG. 3 shows how to draw upward a pattern plate 1, which fits into the carrier plate 2, from it. The first lifting cylinder 5 is actuated to extend the piston rod 5A (the second and third lifting cylinders are not actuated), so that the mount table 7 and eight draw pins 11, 11A are lifted. While they are being lifted the guide rods 12, 12A of the second and third lifting cylinders 8, 8A are extended in order to guide the mount table 7. All the draw pins 11, 11A pass through the throughbores 4, 4A and draw the pattern plate 1 upward from the carrier plate 2. This pattern plate that has been drawn upward is shown in FIG. 3. A pattern-plate-receiving tool (not shown) is then inserted under the pattern plate 1, and the piston rod 5A of the first lifting cylinder 5 is retracted. Thus the pattern plate 1 is put on the tool, and it is discharged. Later, the piston rod 5A is again extended, and another pattern plate is put on the lifted draw pins 11, 11A The piston rod 5 is then retracted, so that the pattern plate fits into the carrier plate 2.

Figure 4:
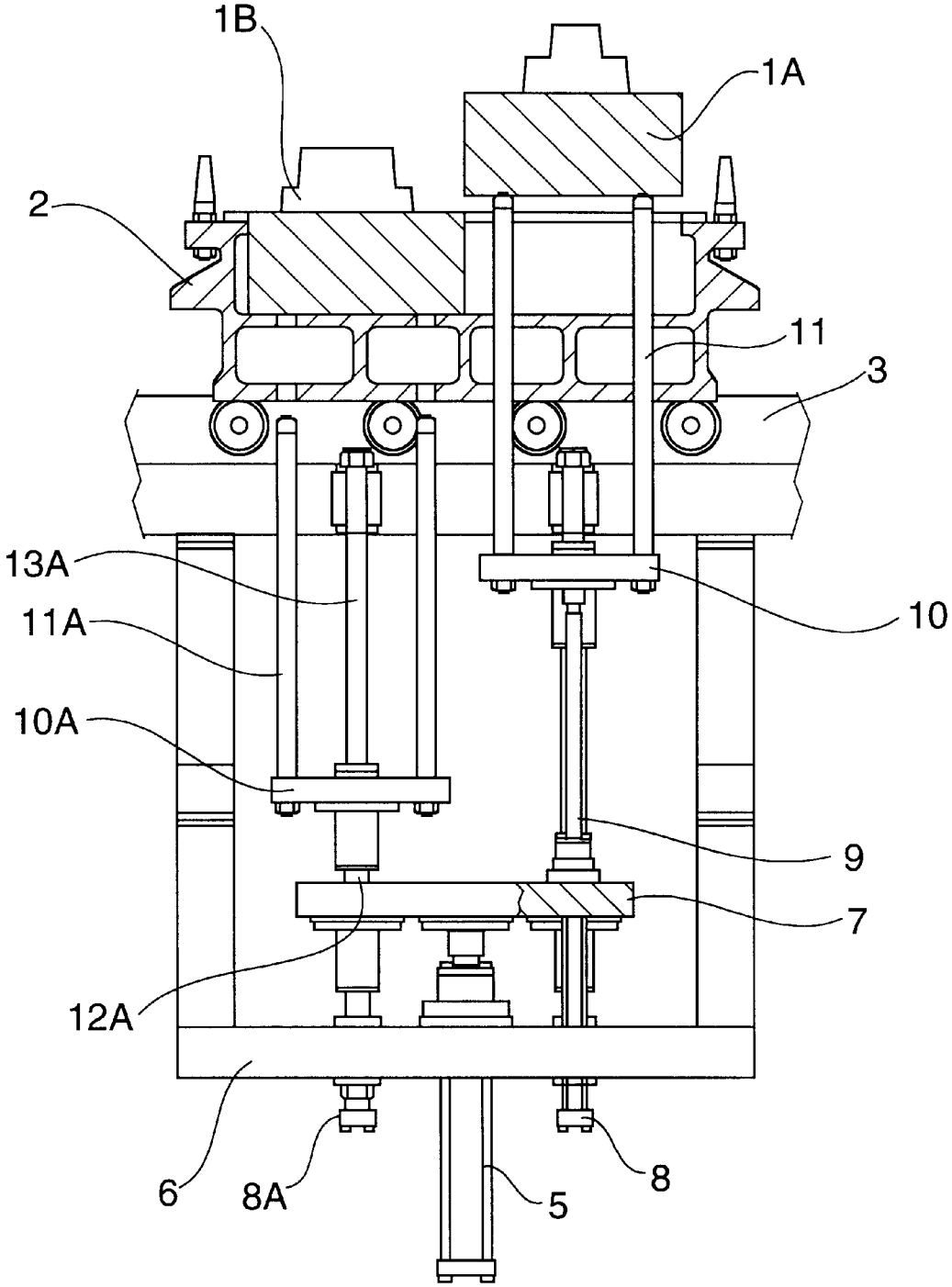
FIG. 4 is a cross-sectional side view similar to FIG. 1, where one of two pattern plates is drawn upward.

When the two pattern plates 1A, 1B of FIG. 4 are simultaneously drawn upward from the carrier plate 2 which holds them, the same method is used as that explained in connection with FIG. 3.

As in FIG. 4, when only one pattern plate 1A of two pattern plates 1A, 1B is drawn upward, the piston rod 9 of the second lifting cylinder 8 is extended from the position shown in FIG. 1. As a result, four draw pins pass through the corresponding throughbores and push up the pattern plate 1A from the carrier plate 2. The pattern plate 1A is discharged, and a new pattern plate is placed in the carrier plate in the same way as explained above.

When only pattern plate 1B is drawn upward, the third lifting cylinder 8A is actuated.

The above embodiments are exemplary only, and the scope of the invention is not limited to them. It will be clear to one skilled in the art that variations can be made to the embodiments.

What we claim is:

1. An apparatus for drawing a pattern plate upward from a carrier plate, said apparatus comprising:

a pattern plate;

a carrier plate which holds the pattern plate, wherein the carrier plate is configured to move the pattern plate along a transport path;

a first lifting cylinder having an upwardly extendable piston rod and that is fixedly disposed below the transport path;

a mount table secured to a tip end of the first lifting cylinder piston rod; and second and third lifting cylinders mounted on said mount table in a spaced-apart relationship, said second and third lifting cylinders each having an upwardly extendable piston rod, a mount plate secured to a tip end of said piston rod, and a plurality of draw pins mounted upright on said mount plate, wherein each of the second and third lifting cylinders is configured to be moved into a position in which at least one of the draw pins thereof engages the pattern plate and gushes said pattern plate upward relative to the carrier plate.

2. An apparatus for drawing a pattern plate upward from a carrier plate, said apparatus comprising:

a pattern plate;

a carrier plate which holds the pattern plate, wherein the carrier plate is configured to move the pattern plate along a transport path;

a fixed frame member disposed below said transport path;

a first lifting cylinder mounted on said frame member, said first lifting cylinder having an upwardly extendable piston rod;

a mount table secured to a tip end of said first lifting cylinder piston rod; and second and third lifting cylinders mounted on said mount table in a spaced-apart relationship, said second and third lifting cylinders each having an upwardly extendable piston rod, said second and third lifting cylinders each including a mount plate secured to a tip end of said piston rod and a plurality of draw pins mounted upright on said mount plate, wherein each of the second and third lifting cylinders is configured to be moved into a position in which at least one of the draw pins thereof engages the pattern plate and pushes said pattern plate upward relative to the carrier plate.

3. The apparatus of claim 2, wherein each of said second and third lifting cylinders further comprises a guide member extending in a direction opposite the direction of said second and third lifting cylinder piston rods and engaging said frame member.

4. An apparatus for drawing a pattern plate upward from a carrier plate, comprising:

at least one pattern plate;

a carrier plate which holds the at least one pattern plate, wherein the carrier plate is configured to move said at least one pattern plate along a transport path, said carrier plate having a plurality of throughbores in the bottom thereof;

a first lifting cylinder fixedly mounted below said transport path, said first lifting cylinder having an upwardly extendable piston rod;

a mount table secured to a tip end of said first lifting cylinder piston rod; and second and third lifting cylinders mounted on said mount table in a spaced-apart relationship, said second and third lifting cylinders each having an upwardly extendable piston rod, said second and third lifting cylinders each including a mount plate secured to a tip end of said piston rod and a plurality of draw pins mounted upright on said mount plate, wherein each of the second and third lifting cylinders is configured to be moved into a position in which at least one of the draw pins thereof engages the at least one pattern plate and pushes said at least one pattern plate upward relative to the carrier plate.

* * * * *